US009950907B2

(12) United States Patent
Moore et al.

(10) Patent No.: US 9,950,907 B2
(45) Date of Patent: Apr. 24, 2018

(54) LIFTING METHODS, ASSEMBLIES AND SYSTEMS

(71) Applicant: Shaw Industrial Group, Inc., Dalton, GA (US)

(72) Inventors: Wes Moore, Rock Spring, GA (US); Charles H. Russell, Woodstock, GA (US)

(73) Assignee: Columbia Insurance Company, Omaha, NE (US)

( * ) Notice: Subject to any disclaimer, the term of this patent is extended or adjusted under 35 U.S.C. 154(b) by 338 days.

(21) Appl. No.: 14/049,414

(22) Filed: Oct. 9, 2013

(65) Prior Publication Data

US 2015/0098781 A1 Apr. 9, 2015

(51) Int. Cl.

| | |
|---|---|
| ***B66C 1/66*** | (2006.01) |
| ***B66C 1/02*** | (2006.01) |
| ***B66C 13/20*** | (2006.01) |

(52) U.S. Cl.

CPC ..... *B66C 1/66* (2013.01); *B66C 1/0256* (2013.01); *B66C 13/20* (2013.01)

(58) Field of Classification Search

CPC ..... B66C 1/66; B66C 1/0212; B66C 13/20; B66C 1/0256

USPC ..... 414/22.62, 627

See application file for complete search history.

(56) References Cited

U.S. PATENT DOCUMENTS

| | | | | |
|---|---|---|---|---|
| 2,477,167 | A * | 7/1949 | Bliss | B21C 47/24 403/108 |
| 3,134,620 | A * | 5/1964 | Blaisdell | B66C 1/46 294/100 |
| 3,318,468 | A | 5/1967 | Olson | 214/650 |
| 3,734,328 | A * | 5/1973 | Dalglish | B21C 47/242 414/620 |
| 3,743,340 | A | 7/1973 | Williamann | 294/64 |
| 3,758,144 | A * | 9/1973 | Dalglish | B66C 1/0212 294/189 |
| 4,358,143 | A | 11/1982 | Cullen | 294/64 |
| 4,412,775 | A | 11/1983 | Molitor | 414/626 |
| 4,413,853 | A | 11/1983 | Anderson | 294/64 |
| 4,453,622 | A * | 6/1984 | Betz | B66C 1/66 188/265 |
| 4,763,941 | A | 8/1988 | Sniderman | 294/64.1 |
| 5,044,868 | A | 9/1991 | Bennison | 414/627 |
| 5,221,117 | A | 6/1993 | Messinger | 294/64.1 |
| 5,330,314 | A | 7/1994 | Bennison | 414/627 |

(Continued)

FOREIGN PATENT DOCUMENTS

| | | |
|---|---|---|
| DE | 3618704 C1 | 6/1987 |
| DE | 3943285 A1 | 8/1990 |

(Continued)

*Primary Examiner* — Michael S Lowe

(74) *Attorney, Agent, or Firm* — Ballard Spahr LLP

(57) ABSTRACT

An assembly, method and system for lifting a package defining an internal aperture. The lifting assembly has an elongate handle configured for attachment to a vacuum lift system, and a lifting tool. The lifting tool has a connecting end configured to attach the lifting tool to the distal end of the handle and a lifting end insertable into the aperture of the package. The lifting end can define an internal chamber. A pin or spindle of a package processing apparatus is insertable into the internal chamber so that the lifting tool can place the package on the spindle.

18 Claims, 5 Drawing Sheets

(56) References Cited

U.S. PATENT DOCUMENTS

| | | | | |
|---|---|---|---|---|
| 5,388,879 | A | 2/1995 | Sekiguchi | 294/64.1 |
| 5,431,469 | A | 7/1995 | Ohno | 294/64.1 |
| 5,634,764 | A | 6/1997 | Replogle | 414/752 |
| 5,934,723 | A | 8/1999 | Schmalz | 294/64.1 |
| 5,988,717 | A | 11/1999 | Foust | 294/64.1 |
| 6,039,530 | A | 3/2000 | Schmalz | 414/627 |
| 6,056,500 | A | 5/2000 | Wicen | 414/627 |
| 6,168,220 | B1 | 1/2001 | Schmalz | 294/64.1 |
| 6,174,125 | B1 * | 1/2001 | Davis | B66F 9/185 294/93 |
| 6,345,850 | B1 | 2/2002 | Foust | 294/64.1 |
| 6,722,605 | B2 * | 4/2004 | Joutsjoki | B65H 19/126 242/533.2 |
| 8,057,374 | B2 | 11/2011 | McDermitt | 483/1 |
| 8,109,548 | B2 | 2/2012 | Jansson | 294/64.1 |
| 8,684,655 | B2 * | 4/2014 | Cannon | A01D 87/127 414/24.5 |
| 2003/0143062 | A1 | 7/2003 | Bennison | 414/627 |
| 2006/0163891 | A1 * | 7/2006 | Slezak | B66C 1/24 294/67.22 |
| 2006/0245889 | A1 * | 11/2006 | Reichert | B66F 9/185 414/607 |
| 2007/0241575 | A1 | 10/2007 | Lundin | 294/64.1 |

FOREIGN PATENT DOCUMENTS

| | | | |
|---|---|---|---|
| DE | 3934922 | A1 | 4/1991 |
| DE | 4229208 | A1 | 3/1994 |
| DE | 19601222 | | 6/2003 |
| EP | 0165814 | | 12/1985 |
| FR | 2683802 | | 5/1993 |
| FR | 2685309 | | 6/1993 |
| FR | 2765203 | | 12/1998 |
| FR | 2909652 | | 6/2008 |
| GB | 2200615 | | 1/1987 |
| JP | 06211482 | | 2/1994 |
| JP | 10007370 | | 1/1998 |
| SE | 506967 | | 3/1998 |
| WO | WO 98/58870 | | 12/1998 |
| WO | WO 2012/130613 | | 10/2012 |

* cited by examiner

LIFTING METHODS, ASSEMBLIES AND SYSTEMS

FIELD OF THE INVENTION

This invention relates generally to methods, assemblies and systems for lifting an object. More specifically, methods, assemblies and systems are provided for lifting and/or repositioning an object defining an internal aperture.

BACKGROUND OF THE INVENTION

Ergonomics are an important consideration in many modern day manufacturing environments. That is, many manufacturing-related processes are now examined to make sure that the effort exerted in their performance is not overly burdensome on an operator. A variety of process-related factors may be considered such as, for example, repetitive motion, the required position of the operator's limbs and/or body, and the size, shape and/or weight of components and/or products that must be manipulated by the operator.

While many of these concerns may be obviated through well thought out process and/or equipment design, some cannot. For example, certain process components or products simply cannot be sufficiently reduced in size and/or weight to achieve a particular ergonomic target. A process employing these components or products may, therefore, be difficult for an operator to perform whether on a repetitive basis or otherwise. Similarly, when an operator is required to manipulate large and/or heavy components or products, there is sometimes a risk of harm to the operator and/or of damage to the components or products.

Many types of specialized process assisting equipment have been developed to assist operators in performing what would otherwise be difficult tasks. For example, vacuum lift devices can use a vacuum force to assist an operator when lifting a product. A known vacuum lift device comprises a vacuum lift unit or tube which is able to expand and contract in an upward and downward direction, and a lift tube expansion control valve. The lift tube expansion control valve can control the level of vacuum in the lift tube by controlling an opening area of the lift tube to cause the lift tube to expand and contract in an upward and downward direction. In this vacuum lift device, for example, an object to be lifted is initially held to the lower end portion of the lift tube by the vacuum force. The object can then be lifted by contracting the lift tube by adjusting the lift tube expansion control valve. Accordingly, the object lifted can be maintained at a desired height by operating the lift tube expansion control valve. If desired, the object can be easily moved horizontally by the operator to another place where the object is maintained at a desired height by the vacuum lift device. The object can then be lowered by adjusting the lift tube expansion control valve.

Attachment means, such as suction cups and the like, are conventionally used to couple the object being lifted to the vacuum lift device. These suction cups generally require that the object have a relatively smooth or flat surface for attachment. Other attachment means are known for coupling the vacuum lift device to odd-shaped products and/or products without a smooth surface.

However, in the manufacture and processing of textiles such as thread, yarn, cloth and the like, the textiles can be wound onto packages such as spools or bobbins that define an internal hollow aperture or tube. These textile packages typically do not have a smooth surface in which to attach a suction cup, and further, the outer diameter of the textile packages can be curved. Thus, textile packages cannot be lifted by a conventional vacuum lift tool and attachment means. What is needed then is a lifting tool configured to safely and quickly lift a package defining an internal aperture to a desired height.

SUMMARY OF THE INVENTION

In accordance with the purpose(s) of this invention, as embodied and broadly described herein, this invention, in one aspect, relates to assemblies, systems and methods for lifting and/or repositioning an object defining an internal aperture.

In one aspect, the lifting assembly comprises an elongate handle configured for attachment to a conventional vacuum lift system, and at least one lifting tool coupled to the handle. The elongate handle can have a proximal end, a distal end, and a central column extending along a handle longitudinal axis. In another aspect, the proximal end of the handle can be fixedly attached to a distal end of a lift unit of the vacuum lift system and the distal end of the handle can be attached to a control valve of the vacuum lift system and/or the at least one lifting tool.

The at least one lifting tool comprises a connecting end and a lifting end. In one aspect, the connecting end of the at least one lifting tool can be coupled to a portion of the distal end of the handle. In another aspect, at least a portion of the lifting end of the lifting tool can be insertable into the aperture of the package. That is, the lifting end of the lifting tool can have an outer diameter that is less than a diameter of the aperture of the package.

Depending on the lifting application, the at least one lifting tool can comprise a lifting arm and/or a tubular lifting tool. In one aspect, the lifting arm can be substantially cylindrical in shape. For example, the lifting arm can be a solid bar that is substantially round in cross-section. In another example, the lifting arm can be formed from a tube that is a substantially annular in cross-section. In use, at least a portion of the lifting end of the lifting arm can be inserted into the aperture of the package. The control valve of the vacuum lift system can be adjusted so that the vacuum lift system lifts the lifting assembly and the package to a desired height.

In one aspect, the connecting end of the tubular lifting tool comprises a means for attaching the tubular lifting tool to the handle. In another aspect, the lifting end of tubular lifting tool comprises at least one sidewall forming a tube and a cover plate enclosing an end of the tube to define an internal chamber having an open end. In use, at least a portion of the lifting end of the tubular lifting tool can be inserted into the aperture of the package. The control valve of the vacuum lift system can be adjusted so that the vacuum lift system lifts the lifting assembly and the package to a desired height. The package can then be placed on a spindle, pin and the like of a package processing apparatus by inserting at least a portion of the spindle through the open end of the tubular lifting tool and into the internal chamber. The control valve can be adjusted to lower the package onto the spindle, and the lifting end of the tubular lifting tool can be removed from the aperture of the package.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DESCRIPTION OF THE PREFERRED EMBODIMENTS

Figure 1:
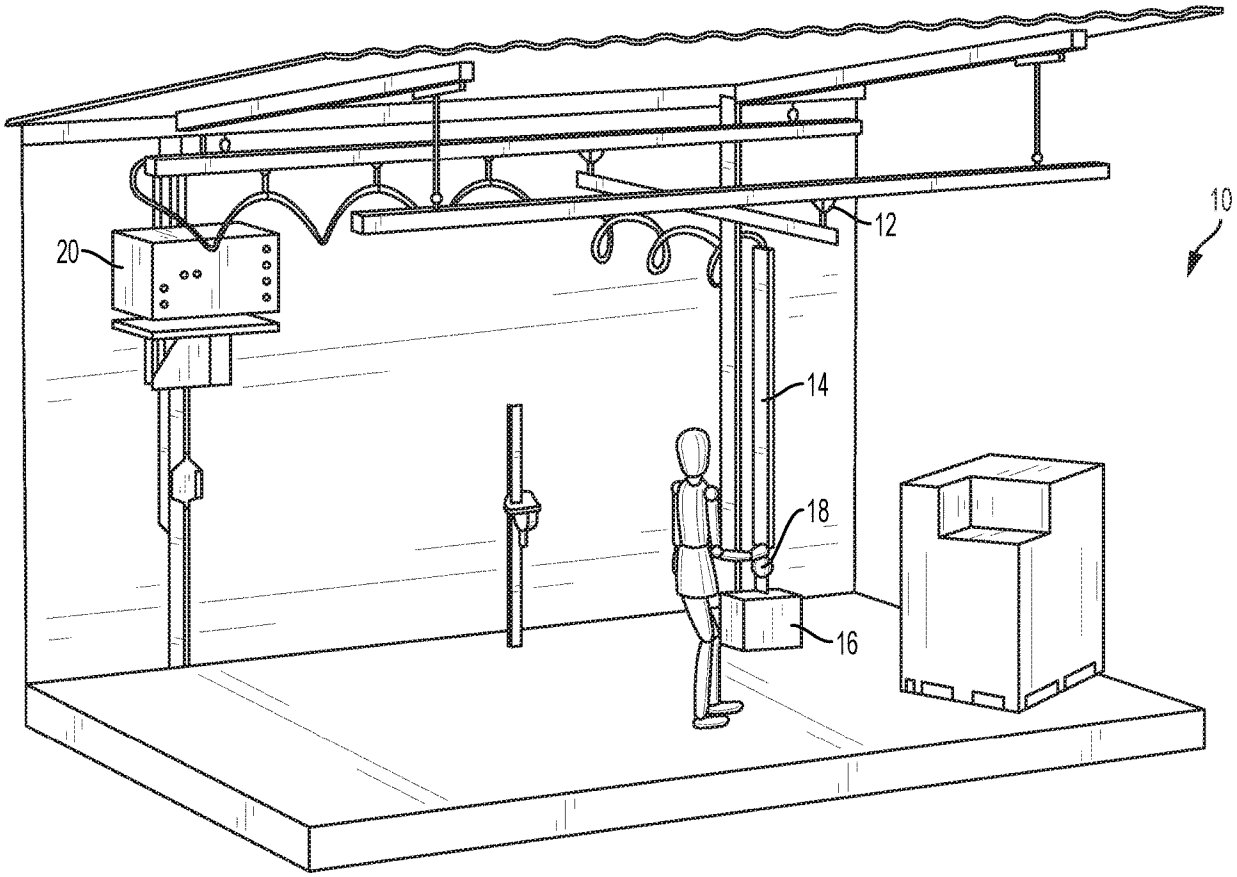
FIG. 1 PRIOR ART
FIG. 1 is a perspective view of a conventional vacuum lift system.

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a yarn" can include two or more such yarns unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

In one broad aspect, the present invention comprises methods, assemblies and systems for lifting a package that defines an aperture extending into the package. More specifically, lifting assemblies are provided for lifting a package having an internal aperture extending into the package using a vacuum lift system.

A conventional vacuum lift system 10, such as a Model VL Lifting System manufactured by Valculex AB of Mölndal, Sweden, is illustrated in FIG. 1. As known in the art, the vacuum lift system can comprise an overhead crane 12, a lift unit 14, a suction foot 16, a control valve 18 and a vacuum pump 20. The vacuum pump can be in sealed fluid communication with the lift unit and the suction foot. In use, a package placed adjacent to the suction foot 16 can be lifted by the suction foot due to the vacuum created and transferred to the suction foot by the lift unit. The operator can control the amount of suction (and thus the height of the package) by adjusting the control valve 18. When the package is lifted, the overhead crane 12 allows the operator to easily move the package horizontally.

Figure 2:
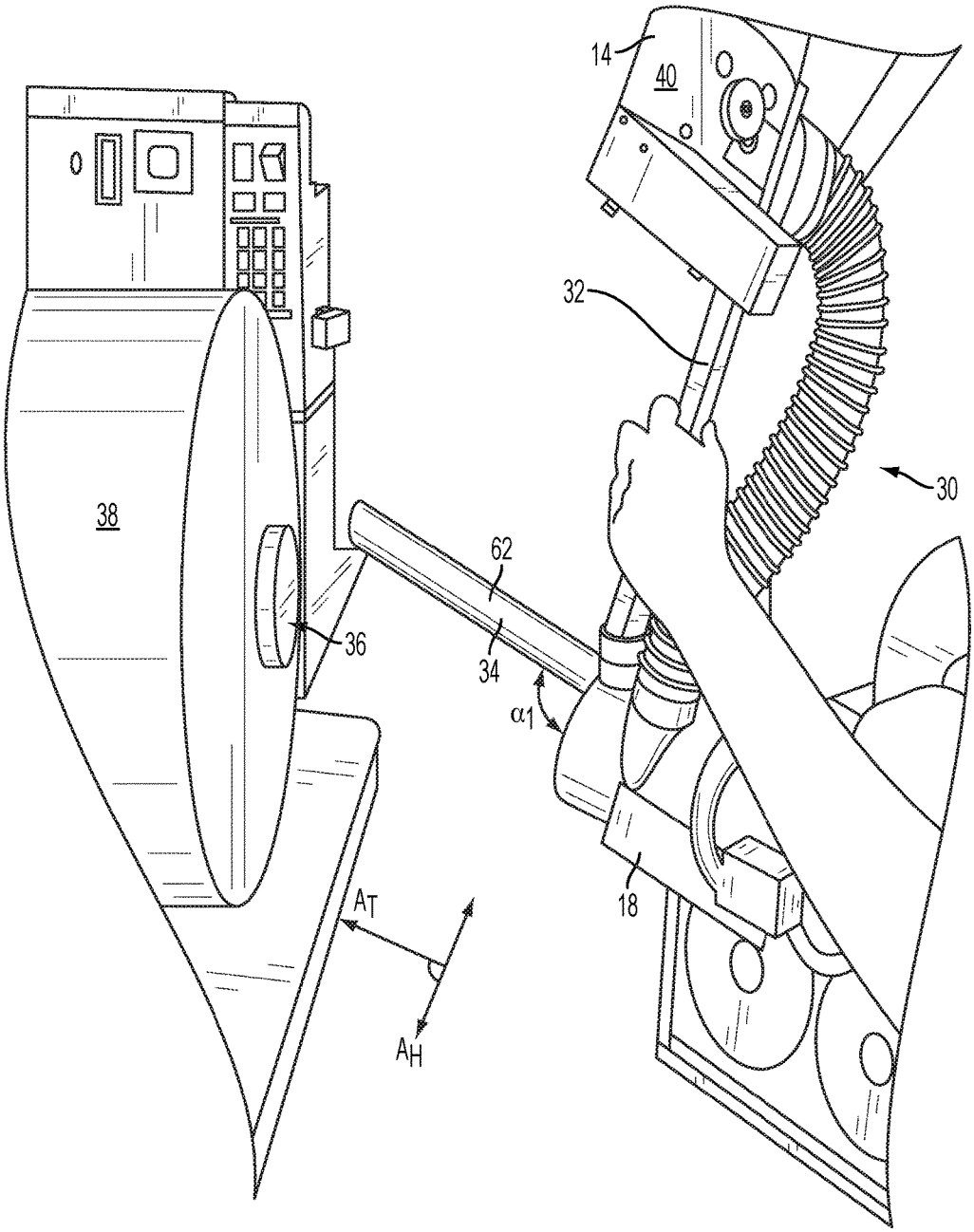
FIG. 2 is a perspective view of a lifting assembly of the present application, according to one aspect, showing a lifting arm and handle coupled to a vacuum lift system.
Figure 3:
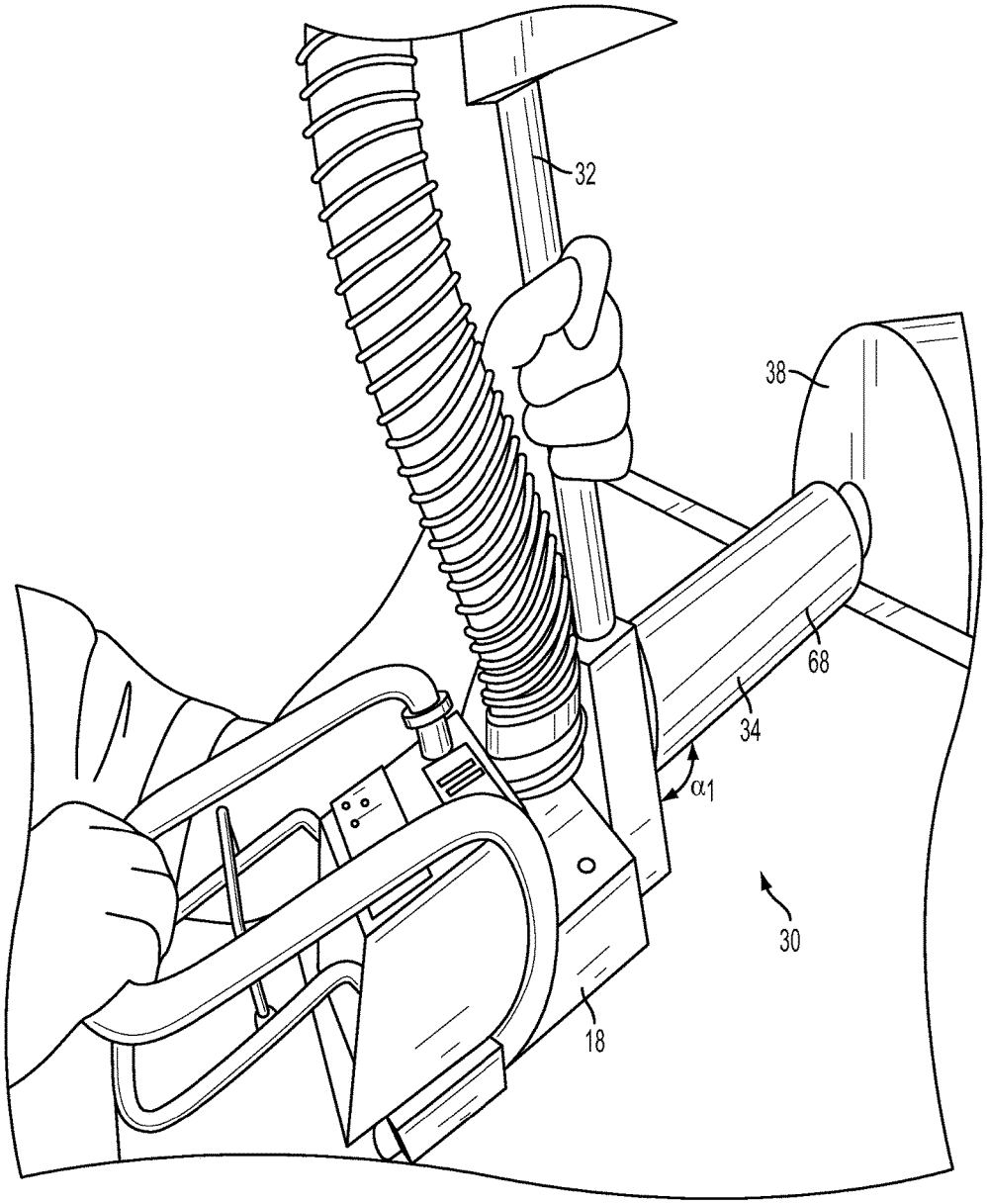
FIG. 3 is a perspective view of a lifting assembly of the present application, according to one aspect, showing a tubular lifting tool and handle coupled to a vacuum lift system.

With reference to FIGS. 2-3, in one aspect, the lifting assembly 30 comprises a handle 32 and at least one lifting tool 34 configured to be inserted in an aperture 36 extending into a package 38. In use, described more fully below, the handle can be fixedly attached to a distal end 40 of the lift unit 14. The at least one lifting tool can be coupled to and extend from a portion of the handle 32 a predetermined distance. At least a portion of the lifting tool can be inserted in the aperture of the package and the control valve 18 can be adjusted by the operator so that the vacuum lift system 10 lifts the package 38 to a predetermined height.

Figure 4C:
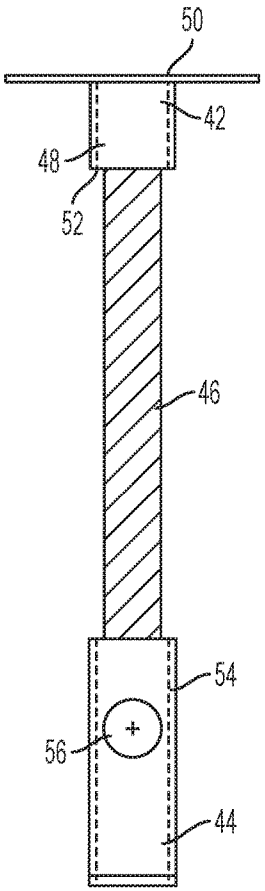
FIGS. 4A-4C are side, back and front elevational views, respectively, of the handle of FIGS. 2 and 3, according to one aspect.
Figure 4B:
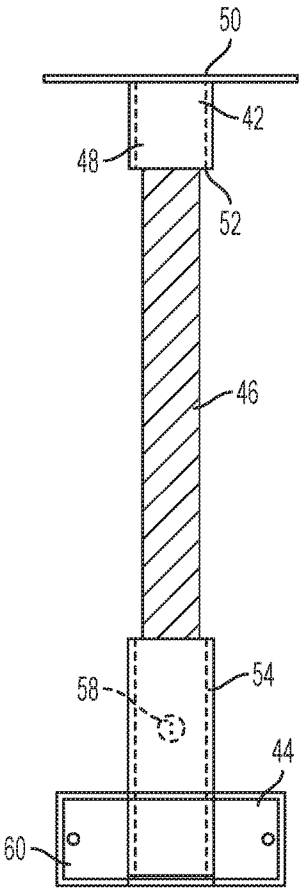
Figure 4A:
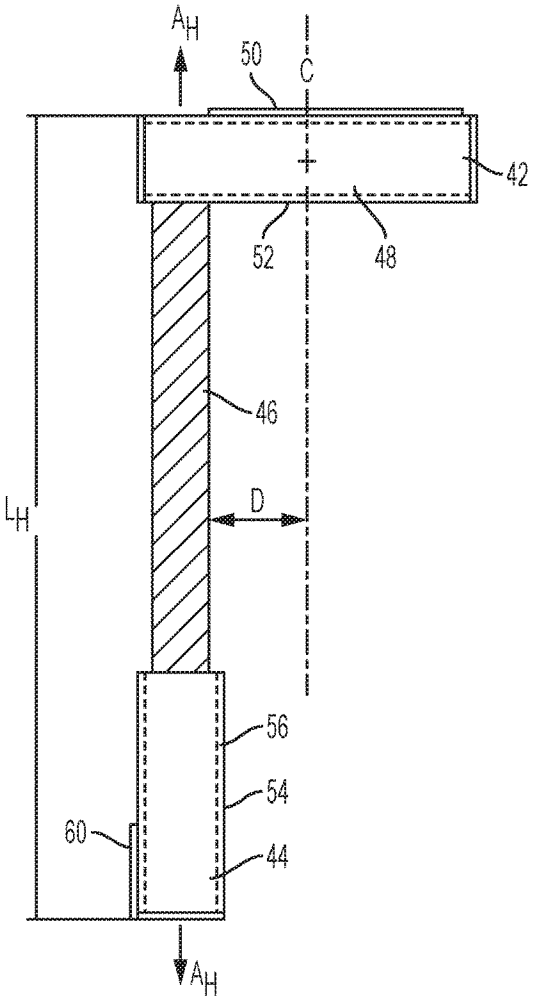

The handle 32 is illustrated in FIGS. 4A-4C, according to one aspect. The handle can be an elongate handle configured to provide the operator a comfortable place to hold when moving the package 38. In one aspect, the handle 32 can have a handle length $L_H$ of less than about 8 inches, about 8.5 inches, about 9 inches, about 9.5 inches, about 10 inches, about 10.5 inches, about 11 inches, about 11.5 inches, about 12 inches, about 12.5 inches, about 13 inches, about 13.5 inches, about 14 inches, about 14.5 inches, about 15 inches and greater than about 15 inches. As can be appreciated, the handle length $L_H$ can be selected as needed to correspond to the size of the package 38 to be lifted. For example, a larger package may require a longer relative handle length, and a smaller package nay require a shorter relative handle length. In one aspect, the handle 32 can have a handle length $L_H$ of about ½ the height of the package. Optionally, in other aspects, the handle can have a handle length of about 10%, about 20%, about 30%, about 40%, about 60%, about 70%, about 80%, about 90%, and about 100% the height of the package.

In another aspect, the handle 32 can have a proximal end 42, a distal end 44, and a central column 46 extending between the proximal and distal ends along a handle longitudinal axis $A_H$. In one aspect, at least a portion of the central column of the handle can be formed from a solid bar or hollow tube that is substantially round in cross-section. For example, the central column 46 can have a diameter of less than about 0.5 inches, about 0.5 inches, about 0.625 inches, about 0.75 inches, about 0.875 inches, about 1 inch, about 1.125 inches, about 1.25 inches, about 1.375 inches, about 1.5 inches, and greater than about 1.5 inches. It is of course contemplated that the central column 46 of the handle can have other shapes in cross-section, such as substantially square or substantially oval. The shape of the central column of the handle 32 can be selected based at least in part on providing a comfortable grasping point for the operator.

In one aspect, the proximal end 42 of the handle 32 can be configured to couple the handle 32 to the distal end 40 of the lift unit 14. For example, a connector member 48 can be formed integrally with or attached to the proximal end 42 of the handle. In this example, the connector member can have a first surface 50 sized and shaped to matingly, securedly engage at least a portion of the distal end of the lift unit 14 with bolts, screws, welds and the like. The central column 46 of the handle 32 can be fixedly attached to the connector member with bolts, welds and the like, so that the central column extends away from a second surface 52 of the connector member 48. In one aspect, and when viewed from the side as in FIG. 4A, the handle longitudinal axis $A_H$ can be offset laterally a predetermined distance D from a center C of the connector member 48. Thus, the handle longitudinal axis $A_H$ can be offset laterally a predetermined distance D from a center of the lift unit 14 of the vacuum lift system.

The distal end 44 of the handle 32 can be configured to selectively couple the handle to the at least one lifting tool 34. In one aspect, at least a portion of the distal end of the handle can form an attachment sleeve 54 configured to couple the handle to the at least one lifting tool. In this aspect, the attachment sleeve can be formed integrally with the distal end 44 of the handle. Optionally, the attachment sleeve 54 can be formed separately from and attached to the distal end of the handle 32 with bolts, welds, screws and the like. The attachment sleeve 54 can be formed from a solid bar or hollow tube that is substantially round in cross-section. Alternatively, the attachment sleeve can be formed from a solid bar or hollow tube that is substantially square or rectangular in cross-section. In another aspect, the attachment sleeve 54 can have a width of less than about 0.5 inches, about 0.5 inches, about 0.75 inches, about 1 inch, about 1.25 inches, about 1.5 inches, about 1.75 inches, about 2 inches, about 2.25 inches, about 2.5 inches and greater than about 2.5 inches.

In one aspect, a bore 56 can be defined in a portion of the attachment sleeve 54. The bore can be sized to matingly engage a portion of the at least one lifting tool 34. For example, an outer bore wall can be threaded to engage complementary threads formed on a portion of the at least one lifting tool. In another example, a hole 58 for a set screw, bolt and the like can be defined in a portion of the attachment sleeve 54. In this example, the set screw, bolt and the like can be inserted into the hole to fixedly attach the at least one lifting tool 34 in the bore 56 to the attachment sleeve.

In one aspect, a mounting plate 60 can be fixedly attached to a portion of the handle 32 or the attachment sleeve 54. The mounting plate can be configured to couple the attachment sleeve (and the handle 32) to the control valve 18 of the vacuum lift system 10 with bolts, screws, welds and the like. Thus, with the handle in place, the control valve can be spaced from the lift unit 14 of the vacuum lift system by the length of the handle.

Figure 5:
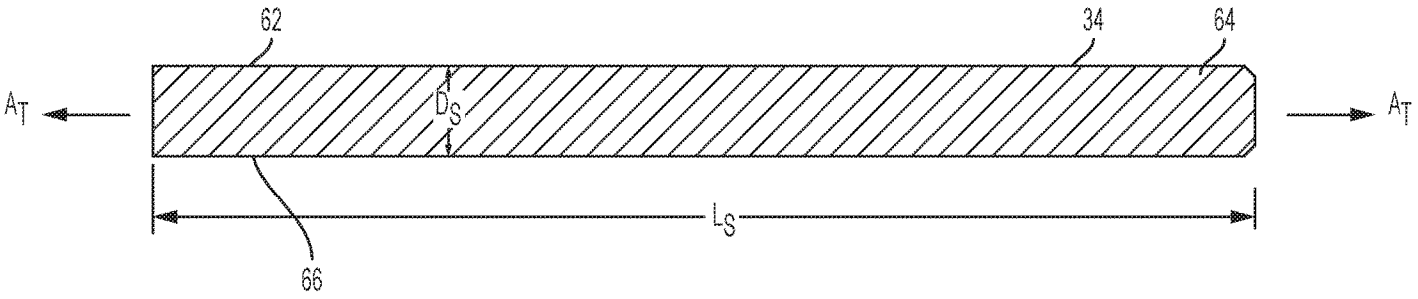
FIG. 5 is a side elevational view of the lifting arm of FIG. 2, according to one aspect.

The at least one lifting tool 34 can be configured so that at least a portion of the at least one lifting tool can be inserted into the aperture 36 of a package 38 so that the package can be lifted. In one aspect, the at least one lifting tool can comprise a lifting arm 62 as illustrated in FIG. 5, having a longitudinal axis $A_T$. In this aspect, the lifting arm can be substantially cylindrical in shape. For example, the lifting arm 62 can be a solid bar substantially round in cross-section, though other shapes such as substantially square and substantially oval are contemplated. It is also contemplated that the lifting arm 62 can be formed from a tube that is a substantially annular in cross-section.

In one aspect, the lifting arm can have a lifting end 64 sized and shaped to be inserted into the aperture 36 of a package 38. For example, a portion of the lifting end of the lifting arm 62 can be chamfered so that the lifting end 64 can be inserted into the aperture more easily. In another aspect, the lifting end of the lifting arm can have a diameter $D_S$ that is less than the diameter of the aperture 36 of the package. For example, the diameter $D_S$ of the lifting arm can be less than about 0.5 inches, about 0.5 inches, about 0.625 inches, about 0.75 inches, about 0.875 inches, about 1 inch, about 1.125 inches, about 1.25 inches, about 1.375 inches, about 1.5 inches, and greater than about 1.5 inches. While the lifting arm 62 is shown in FIG. 5 as having a substantially constant diameter, it is contemplated that the diameter of the lifting arm can vary along a length of the lifting arm 62. That is, in one aspect, a connecting end 66 of the lifting arm can have a diameter that is different than the diameter of the lifting end 64 of the lifting arm 62. In a further aspect, the lifting arm 62 can have an arm length $L_S$ sized to correspond to the size of the package 38 to be lifted. For example the lifting arm 62 can have a arm length $L_S$ of less than about 8 inches, about 8.5 inches, about 9 inches, about 9.5 inches, about 10 inches, about 10.5 inches, about 11 inches, about 11.5 inches, about 12 inches, about 12.5 inches, and greater than about 12.5 inches.

The connecting end 66 of the lifting arm 62 can comprise a means for attaching the lifting arm to the handle 32. In one aspect, the connecting end of the lifting arm 62 be sized and shaped to matingly engage the bore 56 of the attachment sleeve 54. In another aspect, a portion of the connecting end of the lifting arm 62 can be threaded to engage complementary threads formed on a portion of the attachment sleeve. Optionally, in another aspect, a portion of the connecting end 66 of the lifting arm can be drilled and tapped to receive a fastener, such as a bolt, screw and the like. In this aspect, the fastener can fixedly attach the lifting arm 62 to the attachment sleeve 54. In still another aspect, the connecting end of the lifting arm can be fixedly attached to a portion of the attachment sleeve 54 with welds.

In one aspect, the lifting arm 62 can be fixedly attached to the attachment sleeve 54 so that the longitudinal axis of the lifting arm $A_T$ is substantially normal to the longitudinal axis of the handle $A_H$. Optionally, and with reference to FIG. 2, the lifting arm can be fixedly attached to the attachment sleeve so that the longitudinal axis of the lifting arm $A_T$ is at a first angle $\alpha_1$ relative to the longitudinal axis of the handle $A_H$. In another aspect, the lifting arm 62 can be fixedly attached to the attachment sleeve 54 so that the longitudinal axis of the lifting arm $A_T$ is substantially normal to the longitudinal axis of the handle $A_H$ when viewed from above (i.e., when looking down along the longitudinal axis of the handle $A_H$). That is, the longitudinal axis of the handle $A_H$ and the longitudinal axis of the lifting arm $A_T$ can be substantially coplanar. Optionally, when viewed from above, the lifting arm 62 can be fixedly attached to the attachment sleeve 54 so that the longitudinal axis of the lifting arm $A_T$ is at a second angle $\alpha_2$ relative to the longitudinal axis of the handle $A_H$ so that the longitudinal axis of the lifting arm $A_T$ and the longitudinal axis of the handle $A_H$ are not coplanar. In one aspect, the first angle $\alpha_1$ and/or the second angle $\alpha_2$ formed between the longitudinal axis of the lifting arm $A_T$ and the longitudinal axis of the handle $A_H$ can be less than about 10 degrees, about 10 degrees, about 20 degrees, about 30 degrees, about 40 degrees, about 45 degrees, about 50 degrees, about 60 degrees, about 70 degrees, about 80 degrees, or about 90 degrees.

Figure 6:
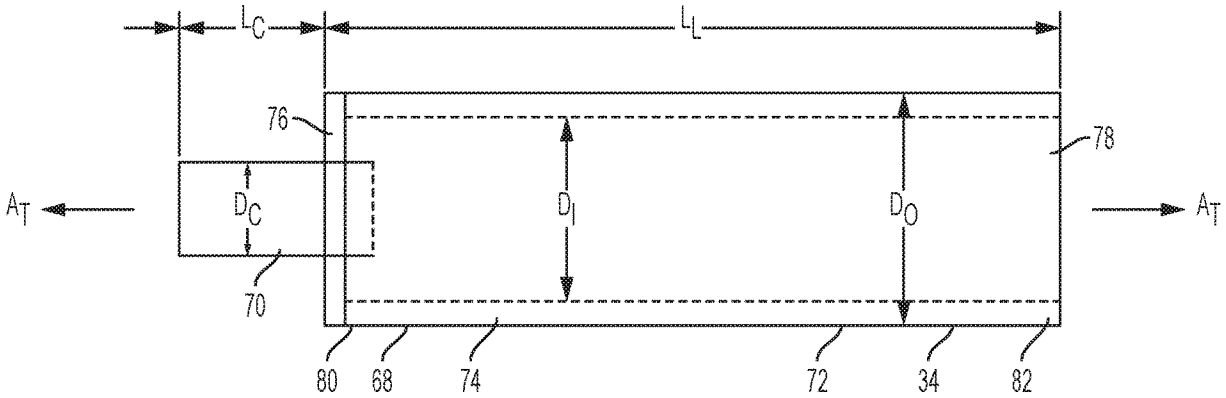
FIG. 6 is a side elevational view of the tubular lifting tool of FIG. 3, according to one aspect.

As illustrated in FIG. 6, in one aspect, the at least one lifting tool 34 can comprise a tubular lifting tool 68 having a longitudinal axis $A_T$. In one aspect, the tubular lifting tool can comprise a connecting end 70 comprising a means for attaching the tubular lifting tool 68 to the handle 32, and a lifting end 72 configured to engage and the lift the package 38. In another aspect, the connecting end can be configured to matingly engage the bore 56 of the attachment sleeve 54. In another aspect, a portion of the connecting end 70 of the tubular lifting tool can be threaded to engage complementary threads formed on a portion of the attachment sleeve. Optionally, in another aspect, a portion of the connecting end 70 of the tubular lifting tool 68 can be drilled and tapped to receive a fastener, such as a bolt, screw and the like. In this aspect, the fastener can fixedly attach the tubular lifting tool to the attachment sleeve 54. In still another aspect, the connecting end 70 of the tubular lifting tool can be fixedly attached to a portion of the attachment sleeve 54 with welds. In one aspect, at least a portion of the tubular lifting tool 68 can be substantially circular or substantially annular in cross-section, though other shapes such as substantially square and substantially oval are contemplated.

In one aspect, the diameter $D_C$ of the connecting end 70 of the tubular lifting tool 68 can be less than about 0.5 inches, about 0.5 inches, about 0.625 inches, about 0.75 inches, about 0.875 inches, about 1 inch, about 1.125 inches, about 1.25 inches, about 1.375 inches, about 1.5 inches, and greater than about 1.5 inches. In a further aspect, the connecting end 70 of the tubular lifting tool 68 can have a length $L_C$ of less than about 0.5 inches, about 0.5 inches, about 0.625 inches, about 0.75 inches, about 0.875 inches, about 1 inch, about 1.125 inches, about 1.25 inches, about 1.375 inches, about 1.5 inches, about 1.75 inches, about 1.875 inches, about 2 inches, about 2.125 inches, about 2.25 inches, about 2.375 inches, about 2.5 inches and greater than about 2.5 inches.

The lifting end 72 of the tubular lifting tool 68 can be sized and shaped to be inserted into the aperture 36 of a package 38. In one aspect, the lifting end of tubular lifting tool can comprise at least one sidewall 74 and a cover plate 76 that define an internal chamber 78. In this aspect, the cover plate can enclose a first end 80 of the internal chamber and can fixedly attach the connecting end 70 of the tubular lifting tool 68 to the lifting end 72. For example, a portion of the connecting end of the tubular lifting tool can be threaded to engage complementary threads formed on a portion of a bore of the cover plate 76. Alternatively, in another example, a portion of the connecting end 70 of the tubular lifting tool 68 can be fixedly attached to the lifting end 72 with bolts, welds and the like.

In another aspect, the at least one sidewall 74 of the lifting end 72 of the tubular lifting tool 68 can have an outer diameter $D_O$ less than the diameter of the aperture of the package. For example, the outer diameter $D_O$ of the at least one sidewall can be less than about 0.5 inches, about 0.5 inches, about 0.625 inches, about 0.75 inches, about 0.875 inches, about 1 inch, about 1.125 inches, about 1.25 inches, about 1.375 inches, about 1.5 inches, about 1.75 inches, about 1.875 inches, about 2 inches, about 2.125 inches, about 2.25 inches, about 2.375 inches, about 2.5 inches and greater than about 2.5 inches. In another aspect, the outer diameter $D_O$ of the at least one sidewall 74 of the lifting end 72 can be greater than the diameter $D_C$ of the connecting end 70 of the tubular lifting tool 68.

In one aspect, the at least one sidewall 74 of the lifting end 72 of the tubular lifting tool 68 can have an inner diameter $D_I$ greater than the diameter of a pin, spindle and the like of a package processing apparatus. For example, if the package 38 is a yarn package, the inner diameter of the at least one sidewall 74 of the lifting end 72 of the tubular lifting tool 68 can be greater than the diameter of a spindle of a heat set apparatus upon which the yarn package is to be placed. In another aspect, the inner diameter $D_I$ of the at least one sidewall 74 of the lifting end of the tubular lifting tool can be less than about 0.5 inches, about 0.5 inches, about 0.625 inches, about 0.75 inches, about 0.875 inches, about 1 inch, about 1.125 inches, about 1.25 inches, about 1.375 inches, about 1.5 inches, about 1.75 inches, about 1.875 inches, about 2 inches, about 2.125 inches, about 2.25 inches, about 2.375 inches, about 2.5 inches and greater than about 2.5 inches. It is contemplated that the outer diameter $D_O$ and/or the inner diameter $D_I$ of the at least one sidewall of the lifting end 72 of the tubular lifting tool can vary along a length of the lifting end of the tubular lifting tool 68. That is, in one aspect, the first end 80 of the lifting end of the tubular lifting tool can have an outer diameter $D_O$ and/or an inner diameter $D_I$ that is different than a respective outer diameter or inner diameter of a second end 82 of the lifting end 72 of the tubular lifting tool 68.

In a further aspect, the lifting end 72 of the tubular lifting tool 68 can have a lifting end length $L_L$ of less than about 5 inches, about 5 inches, about 5.5 inches, about 6 inches, about 6.5 inches, about 7 inches, about 7.5 inches, about 8 inches, about 8.5 inches, about 9 inches, about 9.5 inches, about 10 inches, about 10.5 inches, about 11 inches, about 11.5 inches, about 12 inches, and greater than about 12 inches.

In one aspect, the tubular lifting tool 68 can be fixedly attached to the attachment sleeve 54 so that the longitudinal axis of the tubular lifting tool $A_T$ is substantially normal to the longitudinal axis of the handle $A_H$. Optionally, and with reference to FIG. 3, the tubular lifting tool can be fixedly attached to the attachment sleeve so that the longitudinal axis of the lifting tool $A_T$ is at a first angle $\alpha_1$ relative to the longitudinal axis of the handle $A_H$. In another aspect, the tubular lifting tool 68 can be fixedly attached to the attachment sleeve 54 so that the longitudinal axis of the tubular lifting tool $A_T$ is substantially normal to the longitudinal axis of the handle $A_H$ when viewed from above. That is, the longitudinal axis of the handle $A_H$ and the longitudinal axis of the tubular lifting tool $A_T$ can be substantially coplanar. Optionally, when viewed from above (i.e., when looking down along the longitudinal axis of the handle $A_H$), the tubular lifting tool 68 can be fixedly attached to the attachment sleeve 54 so that the longitudinal axis of the tubular lifting tool $A_T$ is at a second angle $\alpha_2$ relative to the longitudinal axis of the handle $A_H$ so that the longitudinal axis of the tubular lifting tool $A_T$ and the longitudinal axis of the handle $A_H$ are not coplanar. In another aspect, the first angle $\alpha_1$ and/or the second angle $\alpha_2$ formed between the longitudinal axis of the tubular lifting tool $A_T$ and the longitudinal axis of the handle $A_H$ can be less than about 10 degrees, about 10 degrees, about 20 degrees, about 30 degrees, about 40 degrees, about 45 degrees, about 50 degrees, about 60 degrees, about 70 degrees, about 80 degrees, or about 90 degrees.

To assemble the lifting assembly 30, the proximal end 42 of the handle 32 can be coupled to the distal end 40 of the lift unit 14 of the vacuum lift system 10 with conventional fasteners, such as bolts, screws, rivets and the like. The attachment sleeve 54 can be integrally formed with the distal end 44 of the handle, or otherwise fixedly attached to the distal end of the handle 32 with bolts, welds, screws and the like. The control valve 18 can be coupled to the handle 32, for example, to the mounting plate 60 of the handle. The at least one lifting tool 34 can be fixedly attached to the attachment sleeve. As can be appreciated, the handle, the attachment sleeve 54 and/or the at least one lifting tool can be formed and provided to the operator as a monolithic device. In this case, different lifting assemblies could be provided to the operator, each having a different style lifting tool. Alternatively, the handle 32 and the attachment sleeve can be formed and provided to the operator as a unitary piece. In this case, the appropriate lifting tool can be selectively attached to the handle by the operator to form the desired lifting assembly.

In use, the operator can select a lifting assembly 30 having a predetermined lifting tool 34 coupled to the handle 32. For example, if the operator is going to simply pick up a package 38 and place it down somewhere else, the operator can select the lifting assembly having the lifting arm 62 coupled to the handle. Alternatively, if the operator is going to place a package on a pin, spindle and the like, the operator can select the lifting assembly 30 having the tubular lifting tool 68 coupled to the handle. In one aspect, the operator can selectively detach an undesired lifting tool 34 from the handle 32, and then selectively attach the desired lifting tool. The operator can use the control valve 18 of the vacuum lift system to raise or lower the height of the lifting tool so that the lifting end 64, 72 of the lifting tool is axially aligned with the aperture 36 of the package 38. The operator can horizontally insert at least a portion of the lifting tool 34 into the aperture, and the control valve can be adjusted so that the vacuum lift system lifts the package to a desired height. It is contemplated that a portion of the lifting end 72 of the tubular lifting tool 68 and/or a portion of the lifting end 64 of the lifting arm 62 can be chamfered so that the respective lifting end 64, 72 can be inserted into the aperture more easily.

To remove the package 38 from the lifting tool 34, the operator can horizontally move the package to the desired location. For example, if the package is going to be placed on a pin, spindle and the like, the tubular lifting tool 68 can be moved horizontally by the operator so that at least a portion of the pin, spindle and the like is inserted into the internal chamber 78 of the tubular lifting tool. The control valve 18 of the vacuum lift system 10 can be adjusted so that the vacuum lift system lowers the package 38 to the desired height and the package is supported by a predetermined surface, such as a floor, table, spindle, and the like. The operator can then horizontally move the lifting tool 34 out of the aperture 36 of the package.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A lifting assembly, for lifting a package with a vacuum lift system and placing the package in a predetermined location, wherein the package defines an aperture extending into the package and the vacuum lift system has a lift unit, a control valve and a vacuum pump, the lifting assembly comprising:

an elongated handle having a proximal end, a distal end, and a central column extending along a handle longitudinal axis between the proximal end and the distal end of the handle, wherein the proximal end of the handle is fixedly attached to a distal end of a lift unit of a vacuum lift system, wherein the lift unit is in sealed communication with a vacuum pump of the vacuum lift system, and wherein the distal end of the handle is coupled to a control valve of the vacuum lift system that selectively controls an amount of suction created by the vacuum lift system to selectively adjust the lifting assembly to a desired height;

a lifting tool having a central portion extending along a lifting tool longitudinal axis between a connecting end and a lifting end, wherein the connecting end is coupled to a portion of the handle and the lifting end of the lifting tool extends horizontally away from the handle and wherein the lifting tool longitudinal axis is substantially normal to the handle longitudinal axis; and wherein the lifting end of the lifting tool is insertable into an aperture defined in the package, wherein the amount of suction is selectively adjusted by the control valve to selectively adjust the lift assembly to a desired height; and wherein the lift unit does not transfer suction to the package.

2. The lifting assembly of claim 1, wherein the handle longitudinal axis and the lifting tool longitudinal axis are substantially coplanar.

3. The lifting assembly of claim 1, wherein the lifting tool longitudinal axis is at an acute angle relative to the handle longitudinal axis.

4. The lifting assembly of claim 3, wherein the handle longitudinal axis and the lifting tool longitudinal axis are substantially coplanar.

5. The lifting assembly of claim 1, wherein at least a portion of the lifting tool is cylindrical in shape.

6. The lifting assembly of claim 1, wherein the lifting tool has an outer diameter that is less than a diameter of the aperture of the package.

7. The lifting assembly of claim 6, wherein at least a portion of the lifting end of the lifting tool is chamfered.

8. The lifting assembly of claim 6, wherein the lifting tool comprises a lifting arm that extends from the lifting end towards the connecting end of the lifting tool along the lifting tool longitudinal axis, wherein the lifting arm is substantially cylindrical in shape, and wherein the lifting arm is a substantially solid bar.

9. The lifting assembly of claim 6, wherein the lifting tool comprises a tubular lifting tool that extends from the lifting end towards the connecting end of the lifting tool along the lifting tool longitudinal axis, wherein the lifting end of tubular lifting tool comprises at least one sidewall and a cover plate defining an internal chamber.

10. The lifting assembly of claim 9, wherein the predetermined location on which the package is to be placed comprises a spindle, and wherein an inner diameter of the at least one sidewall is greater than the diameter of the spindle.

11. The lifting assembly of claim 9, wherein the cover plate fixedly attaches a connecting end of the tubular lifting tool to the lifting end.

12. The lifting assembly of claim 1, wherein at least a portion of the distal end of the handle comprises an attachment sleeve, wherein the attachment sleeve is configured to couple the handle to the at least one lifting tool.

13. The lifting assembly of claim 12, wherein a bore is defined in a portion of the attachment sleeve, and wherein the bore is sized to matingly engage at least a portion of the connecting end of the at least one lifting tool.

14. The lifting assembly of claim 1, wherein the control valve is spaced from the lift unit of the vacuum lift system by a length of the handle.

15. The lifting assembly of claim 1, further comprising a connector member on the proximal end of the handle, wherein the connector member is configured to fixedly attach the lift unit to the handle, and wherein when viewed from a side elevational view, the handle longitudinal axis is offset laterally a predetermined distance from a center of the connector member.

16. A system for lifting and placing in a predetermined location a package defining an aperture that extends into the package, the system comprising:

a vacuum lift system comprising:

a vacuum pump configured for creating a vacuum force;

a lift unit having a lift proximal end in sealed fluid communication with the vacuum pump and a lift distal end in sealed fluid communication with the lift proximal end, wherein the lift unit is configured to convert the vacuum force from the vacuum pump to a lifting force on a lifting assembly, wherein the lift unit does not transfer suction to the package, and wherein the lifting assembly is fixedly attached to the lift distal end; and a control valve configured to selectively control an amount of suction created by the vacuum lift system to selectively adjust the lifting assembly to a desired height; and wherein the lifting assembly comprises:

an elongated handle having a central column extending along a handle longitudinal axis between a proximal end and a distal end of the handle, wherein the proximal end of the handle is fixedly attached to the distal end of the lift unit of the vacuum lift system, and wherein the distal end of the handle is coupled to the control valve of the vacuum lift system; and a lifting tool, having central portion extending along a lifting tool longitudinal axis between a connecting end and a lifting end, wherein the connecting end is coupled to a portion of the handle and the lifting end of the lifting tool extends away from the handle, and wherein a lifting end of the lifting tool has an outer diameter that is less than a diameter of the aperture of the package, wherein the lifting end of the lifting tool is insertable into the aperture defined in the package, and wherein the lifting tool has a longitudinal axis, and wherein the longitudinal axis of the lifting tool is substantially normal to the handle longitudinal axis.

17. The system of claim 16, wherein the handle longitudinal axis and the longitudinal axis of the at least one lifting tool are substantially coplanar.

18. A method for lifting a package, wherein the package defines an aperture extending into the package, the method comprising:

fixedly attaching a proximal end of a handle having a central column extending along the handle longitudinal axis between a proximal end of the handle and a distal end of the handle to a distal end of a lift unit;

attaching the control valve to a portion of the distal end of the handle;

fixedly attaching a connecting end of a lifting tool to a portion of the handle, wherein a lifting end of the at least one lifting tool has an outer diameter that is less than a diameter of the aperture of the package;

activating the vacuum pump to create a vacuum force;

positioning the lift unit adjacent the package;

adjusting the vacuum force with the control valve so that the lifting end of the lifting tool is axially aligned with the aperture of the package;

inserting at least a portion of the lifting tool into the aperture; and adjusting the control valve so that the lifting tool lifts the package to a desired height, wherein the method does not comprise transferring suction to the package.

* * * * *